US008657277B2

(12) United States Patent
Satsukawa

(10) Patent No.: US 8,657,277 B2
(45) Date of Patent: Feb. 25, 2014

(54) IMAGE FORMING SYSTEM HAVING RING BINDING FUNCTION

(75) Inventor: Takamitsu Satsukawa, Mizuho-machi (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 343 days.

(21) Appl. No.: 13/240,621

(22) Filed: Sep. 22, 2011

(65) Prior Publication Data

US 2012/0076616 A1 Mar. 29, 2012

(30) Foreign Application Priority Data

Sep. 25, 2010 (JP) ..... JP2010-214600

(51) Int. Cl.
*B42B 5/08* (2006.01)

(52) U.S. Cl.
USPC ..... 270/58.09; 270/58.07; 270/58.08; 270/58.12; 270/58.17; 412/38; 412/42

(58) Field of Classification Search
USPC ..... 270/58.07, 58.08, 58.12, 58.17; 412/7, 412/11, 14, 33, 38, 42
See application file for complete search history.

(56) References Cited

U.S. PATENT DOCUMENTS

| | | | | |
|---|---|---|---|---|
| 7,537,205 | B2 * | 5/2009 | Nagata et al. | 270/58.09 |
| 7,878,496 | B2 * | 2/2011 | Fujii et al. | 270/58.07 |
| 7,905,476 | B2 * | 3/2011 | Haramiishi | 270/58.07 |
| 8,132,994 | B2 * | 3/2012 | Okada et al. | 412/14 |
| 8,331,847 | B2 * | 12/2012 | Matsushita et al. | 399/408 |
| 2010/0135713 | A1 | 6/2010 | Haramiishi et al. | |

FOREIGN PATENT DOCUMENTS

| | | |
|---|---|---|
| JP | 2007-030319 A | 2/2007 |
| JP | 2008-094081 A | 4/2008 |

* cited by examiner

*Primary Examiner* — Leslie A Nicholson, III
(74) *Attorney, Agent, or Firm* — Holtz, Holtz, Goodman & Chick

(57) ABSTRACT

An image forming system including a control section provides control in such a way that, the ring binder of the size determined for the first set of copies is adopted so that ring binding is performed for a second set of copies or copies thereafter in a case of executing a job for ring binding of a plurality of copies. When at least one of a status change in the sheet feed section, a main power source being turned off, or a change in a job ticket is occurred from a suspension to a resumption of the job, since the thickness of a bundle of sheets may change, the thickness measuring section is caused to measure the thickness of the bundle in a first set of copies subsequent to resumption. And the control section judges continuation or suspension of a job.

6 Claims, 6 Drawing Sheets

IMAGE FORMING SYSTEM HAVING RING BINDING FUNCTION

The present application is based on Patent Application No. 2010-214600 filed at the Japan Patent Office on Sep. 25, 2010 and which is hereby incorporated herein in its entirety.

TECHNICAL FIELD

The present invention relates to a an image forming system having a ring binding function for binding a bundle of printed sheets by a ring binder.

BACKGROUND

In addition to the printing function, the image forming system performs the function of enhancing the efficiency of clerical work by using a finishing device provided to perform various types of finishing, in recent years. Finishing includes punching, stapling, inserter processing for insertion of a cover sheet or insert sheet, folding processing such as center folding or triple folding, and bookbinding, for example.

One of the bookbinding processes is a step of ring binding, wherein a ring binder disclosed in for example, Unexamined Japanese Patent Application Publication No. 2008_094081 is fitted into a plurality of holes formed on a bundle of sheets. When the ring is closed, a bundle of sheets is ring-bound, whereby a booklet as shown in FIG. 6 is produced.

Matching between the thickness of a bundle of sheets and size of the ring binder is important in ring binding. If a thin bundle of sheets is equipped with a large ring binder, the product looks less attractive. If a thick bundle of sheets is provided with a small ring binder, the booklet will be difficult to open, and usability will be impaired. If a small ring binder is fitted forcibly, a ring binding device may be damaged.

Unexamined Japanese Patent Application Publication No. 2008_094081 discloses a technique of ring binding, wherein a sheet thickness sensor for measuring the thickness of a bundle of sheets is provided. The ring binder suited for the thickness having been measured is selected to perform ring-binding. Further, according to the second embodiment of the Unexamined Japanese Patent Application Publication No. 2008_094081, in the case of a plurality of copies of ring binding, the size of the ring binder determined based on the sheet thickness of the first copy is memorized. When the second copy or copies thereafter are to be printed again, ring binding operation is performed by the ring binder of the memorized size, if the sheet thickness is kept within a prescribed range. This allows the ring binder of the same size to be used when the same image data is ring bound.

The technique disclosed in Unexamined Japanese Patent Application Publication No. 2008_94081 uses a ring binder of the same size to bind booklets which are to be created according to one and the same job. The sheet thickness is measured for each of a plurality of copies of a bundle of sheets. Although Unexamined Japanese Patent Application Publication No. 2008_094081 does not disclose the method for measuring the thickness, it is possible to consider a method wherein a movable gauge is moved to keep a bundle of sheets sandwiched in-between and the moving distance of the movable gauge is measured. In that method, however, measurement of thickness requires a prescribed time. If the thickness is measured for a plurality of all copies, productivity will be reduced.

In view of the problems described above, an object of the present invention is to provide an image forming system characterized by a high degree of productivity and attractive outward appearance wherein booklets produced from one and the same job are bound by a ring binder of the same size.

SUMMARY

To achieve at least one of the above mentioned objects, image forming system reflecting one aspect of the present invention including: a sheet feed section for a feeding sheet; an image forming section for forming an image on the sheet; a punching section for punching a plurality of holes on one side of the sheet; a sheet accommodation section for accommodating and aligning a plurality of punched sheets to form a bundle of sheets; a thickness measuring section for measuring a thickness of the bundle of sheets accommodated in the sheet accommodation section; a size determining section for determining a size of a ring binder to be used, based on information of the thickness of the bundle of sheets measured by the thickness measuring section; a ring binder supply section for accommodating ring binders of different sizes and supplying the ring binder of a determined size; a ring binding section for receiving the ring binder from the ring binder supply section and mounting the ring binder on the bundle of sheets; a control section provides control in such a way that, in a ease of executing a job for ring binding of a plurality of copies, the thickness measuring section is caused to measure a thickness of the bundle in a first set of copies and the size determining section is caused to determines a size of the ring binder to be used, the ring binder of the size determined for the first set of copies is adopted so that ring binding is performed for a second set of copies or copies thereafter, when there is at least one of a status change in the sheet feed section, a main power source being turned off, or a change in a job ticket is occurred from a suspension to a resumption of the job, the thickness measuring section is caused to measure the thickness of the bundle in a first set of copies subsequent to resumption, and the size determining section is caused to determine the size of the ring binder, wherein the control section continues the job using the ring binder with the determined size, if the size of the ring binder determined for the first copy prior to suspension of the job is the same as the size of the ring binder determined for the first copy subsequent to resumption of the job, and suspends image formation and ring binding of the job, if there is a difference in these two sizes.

To achieve at least one of the above mentioned objects, a ring binding method reflecting one aspect of the present invention employed by an image forming system which including: a sheet feed section for a feeding sheet; an image forming section for forming an image on the sheet; a punching section for punching a plurality of holes on one side of the sheet; a sheet accommodation section for accommodating and aligning a plurality of punched sheets to form a bundle of sheets; a thickness measuring section for measuring a thickness of the bundle of sheets accommodated in the sheet accommodation section; a size determining section for determining a size of a ring binder to be used, based on information of the thickness of the bundle of sheets measured by the thickness measuring section; a ring binder supply section for accommodating ring binders of different sizes and supplying the ring binder of a determined size; and a ring binding section for receiving the ring binder from the ring binder supply section and mounting the ring binder on the bundle of sheets, wherein the ring binding method including: a binding step for measuring a thickness of the bundle in a first set of copies and determining a size of the ring binder to be used in a case of executing a job for ring binding of a plurality of copies, and adopting the ring binder based on the size determined for the first set of copies so that ring binding is performed for a second set of copies or copies thereafter; a judging step for judging whether at least one of a status change in the sheet feed section, a main power source being turned off, or a change in a job ticket is occurred from a suspension to a resumption of the job; a comparing step for determining the size of the ring binder of the bundle in a first set of copies subsequent to resumption in the thickness measuring section and the size determining section when it is judged the either occurred and comparing the size of the ring binder determined in a first set of copies beforehand of suspension and the size of the ring binder determined in a first set of copies subsequent to resumption; and a controlling step for continuing the job using the ring binder with the determined size when both sizes are the same by the comparison, and suspending image formation and ring binding of the job when both sizes differ.

DESCRIPTION OF THE PREFERRED EMBODIMENTS

The present embodiment of the image forming system is based on the principle that when a plurality of copies are to be ring bound, a ring binder of the size determined by the measurement of the thickness of the first copy is used for the second copy and copies thereafter. However, with consideration given to the possible mixture of a sheet having the thickness different from that measured for the first copy for some reason, the thickness of a bundle of sheets is measured again in the following cases: (1) wherein there is a status change in the sheet feed device; (2) wherein the main power source has been turned off during suspension; and (3) wherein the job ticket has been updated.

As will be described later, a sheet may have been replaced by another in such cases. Thus, the thickness is measured for the first copy when the image formation has been resumed. The result of measurement is compared with the memorized thickness of the sheet of the first copy. If there is an agreement between the two, the ring binder of the memorized size is used to resume ring binding operations. If agreement is not reached, processing is suspended and an alarm is given to the user.

Figure 1:
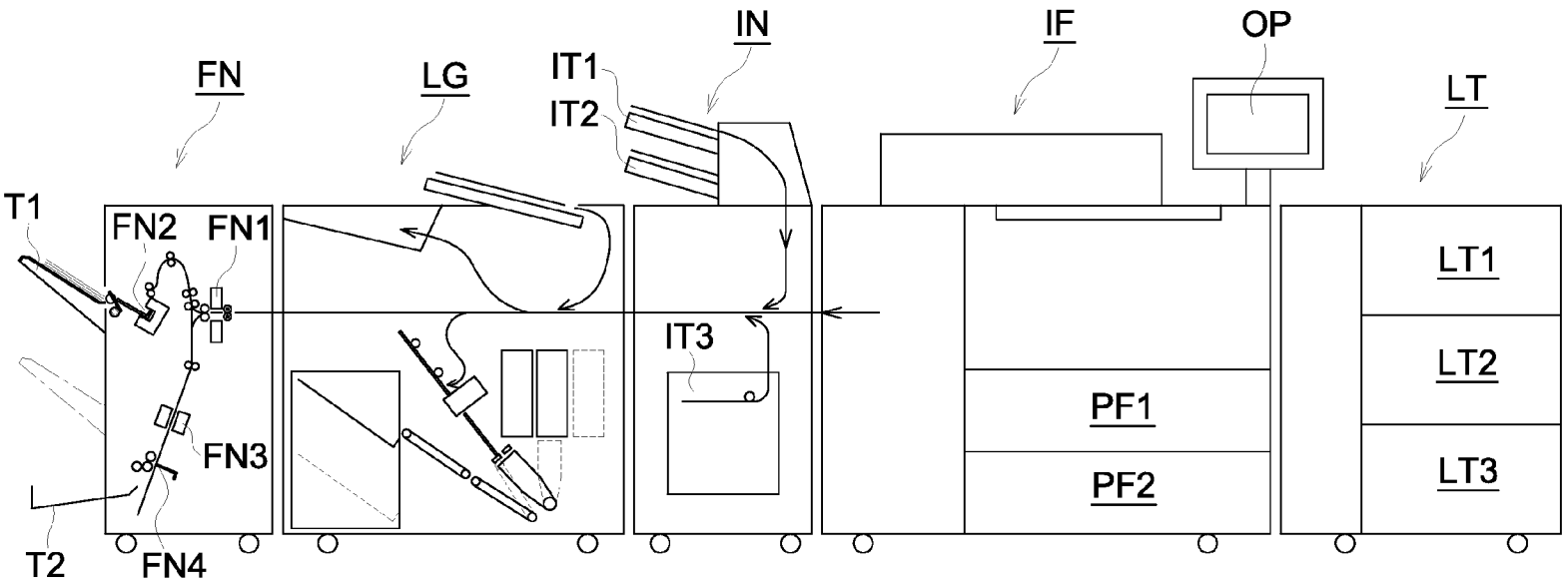
FIG. 1 is a partial cross sectional view showing an image forming system to which the present invention is applied.

FIG. 1 is a cross sectional view showing an image forming system to which the present invention is applied. This image forming system includes a high-volume sheet feed device LT, an image forming apparatus IF, an insertion device IN for insertion of the cover sheet and divider into a bundle of sheets, a ring binding device LG a finisher device FN for various finishing operations, as viewed from the right of the diagram.

The image forming apparatus IF is an example of an image forming section and is used to image formation according to the using electrophotographic process or offset printing process, and is provided with an operation panel OP which is a display/input section.

The high-volume sheet feed device LT has three-tier sheet feed sections (sheet feed section) LT1, LT2 and LT3 for accommodating a high volume of sheets. The image forming apparatus IF also contains two-tier sheet feed sections (sheet feed section) PF1 and PF2. These sheet feed sections are installed removably so that the sheets can be replenished or jam processing is performed. An open/close sensor is installed to detect if these sections are opened or not. The signal coming from the open/close sensor is sent to the control section to be described later.

The insertion device IN is provided with a total of three tiers of sheet feed trays (sheet feed section) IT1, IT2 and IT3 consisting of three upper tiers and internal one tier. It is possible to set the cover sheets or dividing sheets different in color and thickness. The aforementioned sheets are inserted at a prescribed position of a bundle of sheets in conformance to the instructions inputted from the operation panel OP. Similarly to the case of the sheet feed section, these sheet feed trays 1T1, IT2 and IT3 are provided with sensors capable of detecting the open/close status or insertion/removal status.

Further, the finisher device FN is provided with a punching section FN1 for punching two holes for a file, a side stitching section FN2 for side stitching, a saddle stitching FN3 for saddle stitching, and a folding section FN4 for center folding or triple folding of sheets. After various finishing operations have been applied to sheets, sheets are ejected to the elevation tray T1 or lower tray T2. It should be noted that the aforementioned image forming system is only an example, and can be designed in other structures, as a matter of course.

Figure 2:
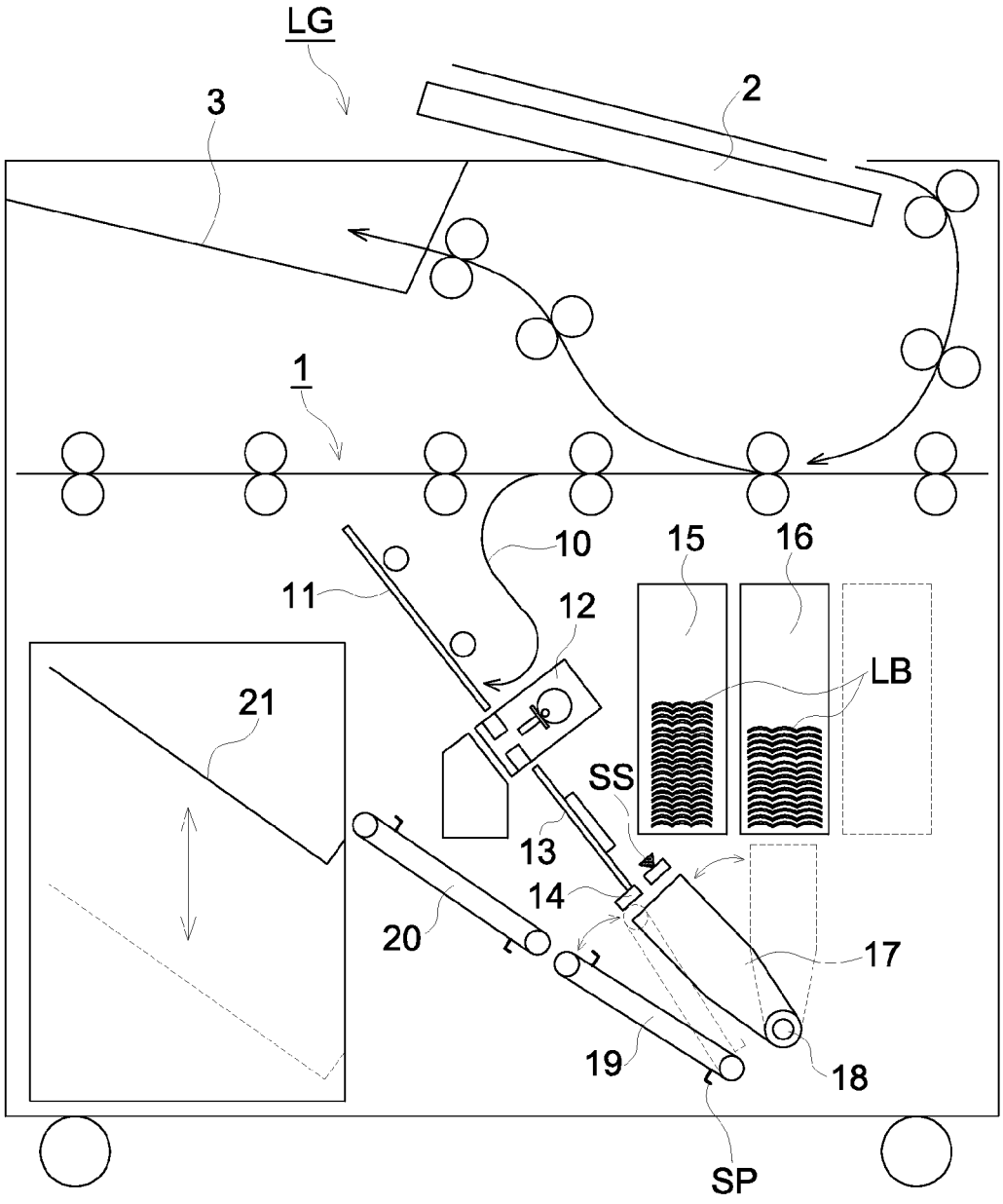
FIG. 2 is a cross sectional view showing a ring binding device in an embodiment of the present invention.

FIG. 2 is a cross sectional view showing an enlarged view of a ring binding device LB in the present invention. In FIG. 2, a horizontal conveyance path 1 is provided across the central top, to convey the sheets coming from the upstream side and to deliver them to the finisher device FN on the downstream side. The top of the device is provided with a sheet feed tray 2. In the off-line ring binding mode, sheets are fed sequentially to the horizontal conveyance path 1. The top of the device is also provided with a sheet ejection tray 3 to eject the sheets that do not undergo the process of finishing by the finisher device FN.

The bookbinding conveyance path 10 branching downward from the center of the horizontal conveyance path 1 is the conveyance path for conveying the sheets subjected to ring binding. Passing through this bookbinding conveyance path 10, the sheets are once fed above the tray 11 arranged in a slanting direction. When the trailing ends of the sheets have been separated from the bookbinding conveyance path 10 the sheets are fed downward along the tray 11 and are stopped by a stopper (not illustrated).

The sheets having been stopped are punched with a plurality of holes for ring binding by a punching device (punching section) 12. The punching device 12 is a commonly known mechanism equipped with a die, a punch, a cam for driving the punch, and a container for accommodating the punched scraps, and is capable of punching a ring binder holes on the sheet.

The punched sheets are fed downward along the second tray (sheet accommodation section) 13, and are stopped by a stopper (not illustrated). When a prescribed number of sheets have accumulated, the trailing end of a bundle of these sheets is held by a gripper 14. The gripper 14 is so designed that one half of the gripper is stationary, while the other half is movable. The movable half of the gripper moves to sandwich a bundle of sheets. The movable half of the gripper is equipped with a thickness measuring sensor SS to measure the thickness of a bundle of sheets. The gripper, thickness measuring sensor SS and holding mechanism thereof constitute the thickness measuring section.

Two cartridges (ring binder supply section) 15 and 16 are mounted on the center fight of the drawing. These cartridges 15 and 16 accommodate the ring binders LB of different sizes, and are movable in the horizontal direction by a moving mechanism (not illustrated). One of these cartridges is moved to the takeup position under control (to be described later). The dotted line shown on the right of the cartridge indicated by the solid line represents that the cartridge 15 on the left has moved to the takeup position.

The ring binding mechanism (ring binding section) 17 is located below the takeup position. This ring binding mechanism 17 is driven around the axis 18 to move between the takeup position and binding position.

The ring binding mechanism 17 takes up one ring binder LB from the cartridge in the takeup position and moves to the binding position. The mechanism then makes ring binder fitted to the trailing edge of a bundle of sheets sandwiched by the gripper 14. A commonly known method as described in Unexamined Japanese Patent Application Publication No. 2008_094081 can be used to fit the ring binder.

The booklet fitted with the ring binder moves along the belt conveying device 19 (indicated by a broken line) below the gripper 14, and is stopped by the stopper SP. The belt conveying device 19 rotates to the solid line position in the drawing, and the belt is driven in the counterclockwise direction so that the booklet is delivered to the second belt conveying device 20. The second belt conveying device 20 conveys the booklet, and ejects it into the ejection tray 21 capable of moving in the vertical direction. The portion of the illustrated frame line including the ejection tray 21 is designed in such a way as to be pulled out toward the front of the device. Accordingly, the booklet subjected to ring binding can be taken out. It should be noted that the aforementioned structure is only one example of the ring binding device, without the present invention being restricted thereto.

When used for ring binding in a plurality of copies, the present embodiment, the ring binder of the size determined by measurement of the thickness made for the first copy is used for the second copy and copies thereafter, in principle. However, with consideration given to the possible mixture of a sheet having the thickness different from that measured for the first copy for some reason, the thickness of a bundle of sheets is measured again in the following cases: (1) wherein there is a status change in the sheet feed device; (2) wherein the main power source has been turned off during suspension; and (3) wherein the job ticket has been edited.

In this case, suspension of the job occurs when the job being executed is suspended by the interrupt function or stop function, or information on job processing is stored in the memory and the job is suspended. To be more specific, suspension of the job occurs in the following cases. In any one of these cases, the type of the sheets may have been changed. If the same possibility may occur in addition to the illustrated example, this is included in the target of the present embodiment.

In the first place, when suspension is caused by interrupt function, the type of the sheets may have been changed. Namely, when the user employing the interrupt function has replaced the sheets in the sheet feed device used in the previous job, a change in the type of the sheets may occur. When the sheet of the sheet feed device has been replaced, the information on the type of the sheet should be registered, in principle. However, the user employing the interrupt function considers that use of this function is only temporary and fails to update the information. After completion of using the interrupt function, the original sheet may not be recovered by the user. In this case, when the previous job is resumed after completion of using the interrupt function, the sheet is different from the one to be used for this job.

Assume, for example, the sheets having a basis weight of 64 kg/m$^2$ were used in the previous job, and have been replaced by the sheets having a basis weight of 104.7 kg/m$^2$ to use an interrupt service. Then the difference in the thickness of a bundle of 100 sheets reaches a level of about 5 mm. This difference may require the size of the ring binder to be changed.

In such a case, the sheets may have been replaced by the operation error of the user. This requires the thickness of a bundle of sheets to be measured again.

The sheet feed device is normally equipped with a sensor for detecting the open/close status. This sensor is intended to ensure that the sheets will not be damaged and a paper jam will not occur, when printing has been started in the Open status. In the present embodiment, the information of this sensor is used to check for possible changes in the status of the sheet feed device.

The following describes cases of saving a job: In the first case, processing for the day has been completed although the number of the sheets preset in the job has not yet been processed. The user suspends the operation so that the job will be resumed on the following date. In the second case, the job information (image data and job ticket) was stored in the storage section of the system after execution of the specified job. After that, a new request has been made for additional printing of the stored job.

In such cases, a stop mode is normally selected, wherein the main power source is turned off. In the stop mode, the sheets on the sheet feed device may be replaced. When the main power source is off, even if the sheet feed device is opened or closed, the sensor does not detect this operation. The control section does not know if the sheets have been replaced or not. Accordingly, when the main power source has been turned off, the thickness of a bundle of sheets is measured again.

In a further example, the image data of the stored job is used without being updated, but part of job execution conditions has to be modified to print the stored job again. The job execution conditions are a set of setting information for job execution, and are collectively called the job ticket.

The information contained in the job ticket includes wide-ranging information such as job priority, the number of images, the number of printed copies, sheet size, type of paper (basis weight and paper type information), simple/duplex information, designation of RGB color conversion method, type of color calibration, and finishing setting information (including the insert sheet information).

This job ticket is updated intentionally by the user. When the information on sheets is to be updated, for example, when the simple/duplex mode is to be changed, or when the type of paper is to be changed, the current size of the ring binder may have been outdated. Accordingly, in this case, the thickness of a bundle of sheets is measured again.

Figure 3:
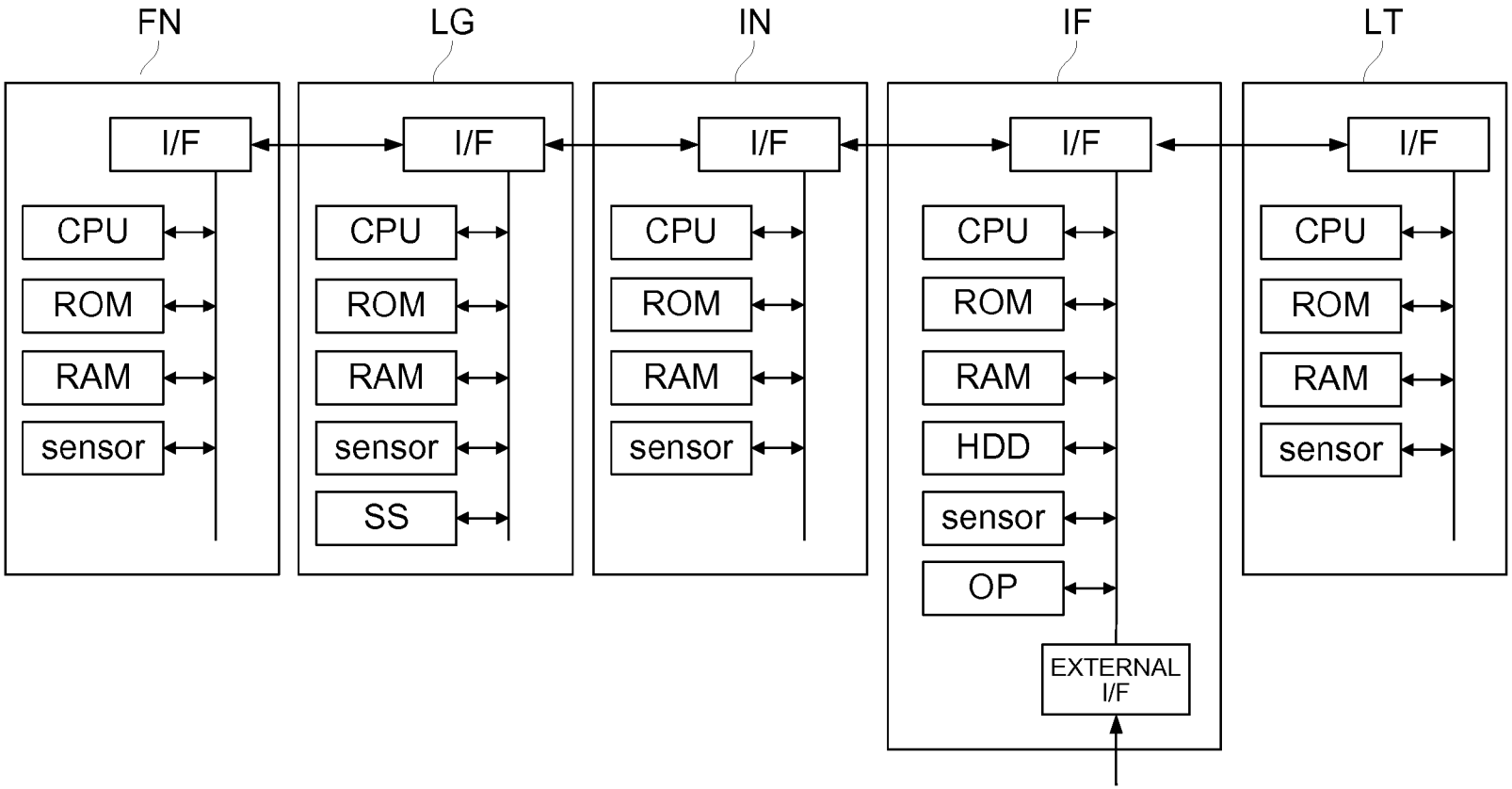
FIG. 3 is a block diagram showing the structure of the control section for control in the present invention.

FIG. 3 is a block diagram showing the structure of the control section for control in the present invention. In FIG. 3, the image forming apparatus IF is provided with a computer system (control section) including such devices as CPU, ROM and RAM, various sensors for inputting device status information, and output section for driving various loads (not illustrated). The image forming apparatus IF also includes a hard disk drive where the job information is stored, an external interface for receiving image information from PC, and so on.

Further, the high-volume sheet feed device LT, insertion device IN, bookbinding device LG and finishing device FN are also equipped with a computer system (control section) including such devices as CPU, ROM and RAM, various sensors mounted on the device, and an output section (not illustrated), although they are not very conspicuous.

The aforementioned control section communicates with one another through an interface to exchange information, and provide control, accordingly.

In the drawing, various sensors are shown in a collective form. Of these, the sensors of the present embodiment includes the open/close sensors of the sheet feed sections LT1, LT2 and LT3 for the high-volume sheet feed device LT; open/close sensors of the sheet feed sections PF1 and PF2 for the image forming apparatus IF; open/close sensors for the sheet feed trays IT1, IT2 and IT3 for the insertion device IN; and a thickness measuring sensor SS (FIG. 2) for the bookbinding device LG.

Figure 4:
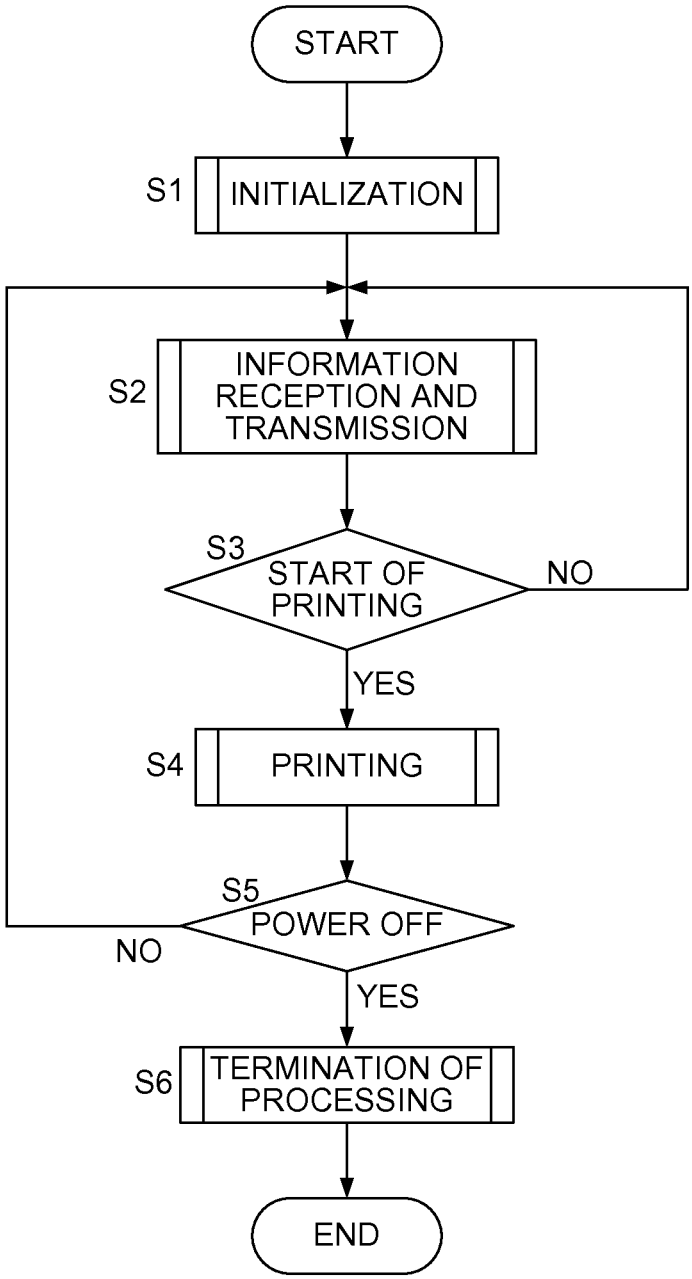
FIG. 4 is a flow chart of the image forming apparatus showing the flow of ring binding in the present invention.
Figure 5:
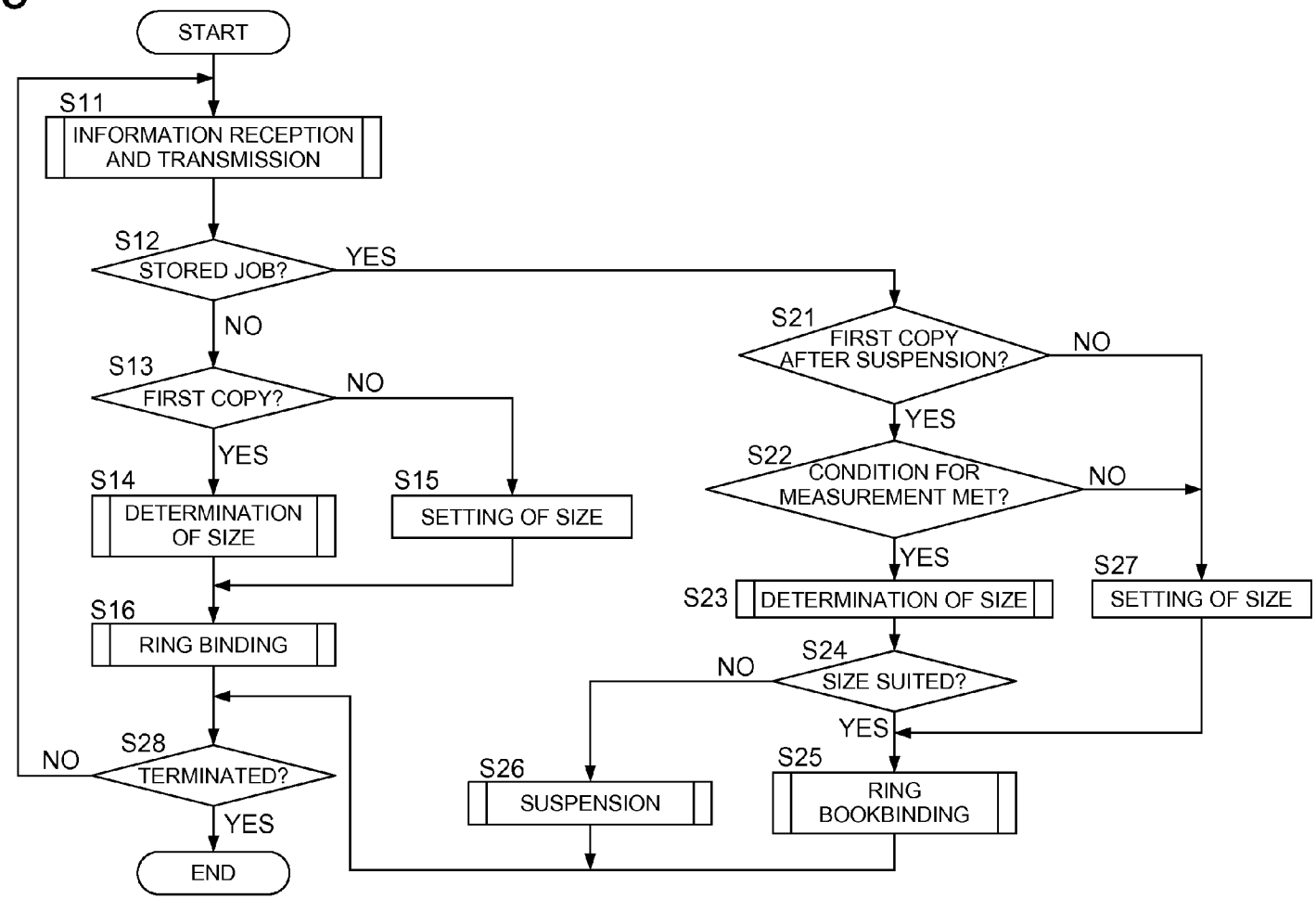
FIG. 5 is a flow chart of the ring binding device showing the flow of ring binding in the present invention.
Figure 6:
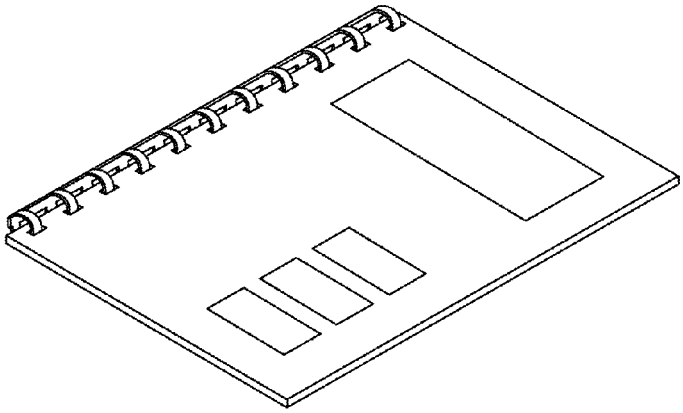
FIG. 6 is a perspective view showing a booklet subjected to ring binding.

FIG. 4 is a flow chart showing the flow of control by the control section. FIG. 4 is a flow chart showing the control section of the image forming apparatus IF. FIG. 5 is a flow chart showing the control section of the ring binding device LG. These drawings illustrate the flow of control in conformance to the program stored in the respective ROMs.

In the first place, the control of the image forming apparatus IF will be described with reference to FIG. 4. When the image forming apparatus IF is turned on, initialization is performed in Step S1. This initialization step includes checking of various loads, warming up of the fixing device, and checking of the stored job data.

In Step S2, the image forming apparatus IF communicates with the high-volume sheet feed device LT, insertion device IN, bookbinding device LG and finishing device FN linked via the interface to receive and transmit information. When printing has started in Step S3, the process of printing is carried out in Step S4. The printing startup instruction is issued when the job startup time preset on a timer is reached, when a printing instruction has been received through the external interface, or when the Start button of the image forming apparatus IF has been pressed to start printing.

In the control of the image forming apparatus IF, a step is taken to check whether or not the power ON instruction has been given in Step S5. If the result is "No", the system goes back to Step S2 to continue control. If the result of Step S5 is "Yes", the system goes to Step S6, and processing of termination is carried out. This processing of termination includes the step of storing the current status of the device and the step of storing the uncompleted part of the job and the job data to be stored, into the hard disk drive.

The Step S1, Step S2, Step S4 and Step S6 represent collections of large-sized processing in a form of sub-routines. Processing of these sub-routines is performed synchronously in parallel with the overall flow.

FIG. 5 is a flow chart showing the control section of the ring binding device LG. When the step has started, information is received and transmitted in Step S11. In this information reception and transmission step, the job print start instruction from the image forming apparatus IF, the job information, and the information on determination and selection of the ring binder size in the present embodiment are received. The current status of the ring binding device LG is transmitted.

In the next Step S12, a decision is made to see whether or not the job is a stored job or not, in conformance to the received information. The stored job includes two types of jobs. One type includes the jobs for which the power source of the image forming system has not been turned off up to the present subsequent to storage of the job, and the other type includes the jobs for which the power source of the image forming system was turned off subsequent to storage, and is then turned on for restart.

If the job is not a stored job according to the decision in Step S12, the system goes to Step S13, and determines whether or not printing is related to the first copy of the job. If printing is related to the first copy, the size of the ring binder used in Step S14 is determined. The permissible bookbinding thickness of the ring binder stored in the carriage at present is stored in the memory. The permissible bookbinding thickness is compared with the result of thickness measurement, whereby the size is determined. In this Step S14, the thickness of the bundle of sheets for the first copy is measured, the ring binder of the suitable size according to the result of measurement is selected, and the size to be used is stored in the memory.

In the meantime, if the reply is "No" in Step S13, the job is related to the second copy and copies thereafter. Accordingly, the size of the ring binder determined for the first copy in Step S14 is set as the size to be used. Thus, the bundles of sheets for the first copy and copies thereafter are bound by the ring binder of the same size. The actual ring binding work is performed in Step S16.

If the result of Step S12 is "Yes", namely, if the job to be printed is a stored job, the system goes to Step S21, and a decision is made to see whether or not the bundle of sheets to be bound at present corresponds to the first copy subsequent to restart after suspension. If "Yes", a decision is made in Step S23 to see whether any of the conditions for re-measurement of thickness is met.

As described above, the thickness of a bundle of sheets is measured again in the following cases: (1) wherein there is a status change in the sheet feed device; (2) wherein the main power source has been turned of during suspension; and (3) wherein the job ticket has been edited. The decision is made according to the information exchanged with the control section of the image forming apparatus IF in the information reception and transmission step If any of the conditions for re-measurement has been met, the thickness is measured and the size is determined in Step S23. The processing in this step is the same as that in the previous Step S14. Then the system goes to Step S24, and evaluates if the determined size is suitable or not. This step is to determine whether or not the size of the ring binder used in the printing of the first job is the same as the size determined in Step S23. This allows the booklets of the same job to be bound by the ring binder of the same size.

If the suitability of the size has been approved in Step S24, ring binding is performed in Step S25. In the meantime, if the suitability of the size has been rejected in Step S24, the system goes to Step S26, and the process of suspension is performed. This process of suspension ejects the bundle of sheets without ring binding. Then an alarm display is given to the user. In this process of suspension, an instruction is issued to the image forming apparatus IF to suspend image formation thereafter. The alarm display provides the user with the information that the size of the ring binder is not appropriate.

In the process of ejecting the sheets without ring binding, the bundle of sheets on the tray 13 is fed to the ejection tray 21 through the belt conveying devices 19 and 20, without being fitted with a ring binder. The sheet in the middle of image formation when the suspension instruction is issued is also ejected.

In the meantime, when the result of Step S21 is "No", namely, when the sheets corresponds to the second copy and copies thereafter subsequent to suspension, or when the conditions for re-measurement are not found out in Step S22, the system goes to Step S27, and sets the size of the ring binder to be used. Then ring binding is completed in Step S25. Setting of the size in Step S27 is a step of registering the size stored in the memory in Step S14 as the size of the ring binder to be used. It is also possible to register the size determined in Step S23.

After Step S16, Step S25 and Step S26, the system goes to Step S28. A step is taken to determine whether or not bookbinding of the job has terminated. If the result is "No", the system goes back to Step S11, and the same flow is executed.

The present embodiment is placed under control according to the flow chart described above. To summarize: For the first copy of the job, the system proceeds in the order of Step S12→S13→S14, then the thickness of the bundle of sheets is measured, and the size of the ring binder is determined according to the result of measurement. For the sheets corresponding to the second copy and copies thereafter, the system proceeds in the order of Step S12→S13→S15, and the size to be used is set without the thickness being measured.

To resume the job once suspended, the system goes from Step S12 to S21. For the first copy, the system proceeds in the order of Step S12→S21→S22→S23→S24. Then the thickness is measured again, and the size is determined. According to the result, a step is taken to determine suitability with the size determined in the process prior to suspension. If suitability has been determined, ring binder of the same size is used for ring binding.

As described above, according to the present embodiment, the ring binder of the same size is used to perform bookbinding for the same job. When the job has been resumed subsequent to suspension, the thickness is measured in the aforementioned specific case, and verification is made to see whether or not ring binding of the same size can be performed. Except when ring binding cannot be performed by the same size for some reason, ring binding of the same size can be maintained both before and after suspension. Further, since the number of measurements of the thickness of the sheet bundle is restricted to the minimum, system productivity can also be enhanced.

The embodiments of the present invention have been described. It is to be expressly understood, however, that the present invention is not restricted thereto. The present invention can be embodied in a great number of variations with appropriate modification. For example, the ring binder has been described with reference to the type disclosed on Unexamined Japanese Patent Application Publication No. 2008_094081. It is also possible to use the ring binder of the type disclosed in the Japanese Unexamined Patent Application Publication No. 2008-505787 (Tokuhyou). The ring binder of this patent application Publication has one spine and a plurality of digital portions extending from this spine. When the digital portion is inserted into the punched hole of the sheet bundle and is connected to the spine after having been made into a round form, a round ring-formed binder is formed. In this ring binder, the position of connecting the digital portion to the spine can be changed in conformity to the thickness of a booklet, and the diameter of the ring binder can be adjusted to a proper level. When the present invention is to be applied to the ring binder of this type, substitute the digital portion connecting position for the size of the ring binder.

The present embodiment has the advantage of providing an image forming system which is characterized by enhanced productivity because the number of measurements of the thickness of the sheet bundle is restricted to the minimum; and by good outward appearance because the booklet produced from one and the same job can be bound by a ring binder of the same size.

What is claimed is:

1. An image forming system comprising:

a sheet feed section for feeding a sheet;

an image forming section for forming an image on the sheet;

a punching section for punching a plurality of holes on one side of the sheet;

a sheet accommodation section for accommodating and aligning a plurality of punched sheets to form a bundle of sheets;

a thickness measuring section for measuring a thickness of the bundle of sheets accommodated in the sheet accommodation section;

a size determining section for determining a size of a ring binder to be used, based on information of the thickness of the bundle of sheets measured by the thickness measuring section;

a ring binder supply section for accommodating ring binders of different sizes and supplying the ring binder of a determined size;

a ring binding section for receiving the ring binder from the ring binder supply section and mounting the ring binder on the bundle of sheets;

a control section provides control in such a way that, in a case of executing a job for ring binding of a plurality of copies, the thickness measuring section is caused to measure a thickness of the bundle in a first set of copies and the size determining section is caused to determines a size of the ring binder to be used, the ring binder of the size determined for the first set of copies is adopted so that ring binding is performed for a second set of copies or copies thereafter, when at least one of a status change in the sheet feed section, a main power source being turned off, or a change in a job ticket is occurred from a suspension to a resumption of the job, the thickness measuring section is caused to measure the thickness of the bundle in a first set of copies subsequent to resumption, and the size determining section is caused to determine the size of the ring binder, wherein the control section continues the job using the ring binder with the determined size, if the size of the ring binder determined for the first copy prior to suspension of the job is the same as the size of the ring binder determined for the first copy subsequent to resumption of the job, and suspends image formation and ring binding of the job, if there is a difference in these two sizes.

2. The image forming system of claim 1, wherein the control section controls to give an alarm to the user and to suspend the job.

3. The image forming system of claim 1, wherein the suspension of the job comprises at least one of a suspension caused by an interrupt function which interrupts a job being executed, a temporary suspension of a job being executed, and a suspension of storing a job being executed to a storage section.

4. The image forming system of claim 1, wherein the job ticket comprises a setting information for a job and for a job execution.

5. The image forming system of claim 4, wherein the setting information comprises a information on simple/duplex print and a type of paper.

6. A ring binding method employed by an image forming system which comprising:

a sheet feed section for feeding a sheet;

an image forming section for forming an image on the sheet;

a punching section for punching a plurality of holes on one side of the sheet;

a sheet accommodation section for accommodating and aligning a plurality of punched sheets to form a bundle of sheets;

a thickness measuring section for measuring a thickness of the bundle of sheets accommodated in the sheet accommodation section;

a size determining section for determining a size of a ring binder to be used, based on information of the thickness of the bundle of sheets measured by the thickness measuring section;

a ring binder supply section for accommodating ring binders of different sizes and supplying the ring binder of a determined size; and a ring binding section for receiving the ring binder from the ring binder supply section and mounting the ring binder on the bundle of sheets, wherein the ring binding method comprising:

a binding step for measuring a thickness of the bundle in a first set of copies and determining a size of the ring binder to be used in a case of executing a job for ring binding of a plurality of copies, and adopting the ring binder based on the size determined for the first set of copies so that ring binding is performed for a second set of copies or copies thereafter, a judging step for judging whether at least one of a status change in the sheet feed section, a main power source being turned off, or a change in a job ticket is occurred from a suspension to a resumption of the job;

a comparing step for determining the size of the ring binder of the bundle in a first set of copies subsequent to resumption in the thickness measuring section and the size determining section when it is judged the either occurred and comparing the size of the ring binder determined in a first set of copies beforehand of suspension and the size of the ring binder determined in a first set of copies subsequent to resumption; and a controlling step for continuing the job using the ring binder with the determined size when both sizes are the same by the comparison, and suspending image formation and ring binding of the job when both sizes differ.

* * * * *